US011859492B2

(12) United States Patent
BinZiad

(10) Patent No.: US 11,859,492 B2
(45) Date of Patent: Jan. 2, 2024

(54) METHOD AND SYSTEM FOR CONNECTING FORMATION FRACTURES USING FRACBOTS

(71) Applicant: SAUDI ARABIAN OIL COMPANY, Dhahran (SA)

(72) Inventor: Abdullah Mohammed BinZiad, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 52 days.

(21) Appl. No.: 17/456,067

(22) Filed: Nov. 22, 2021

(65) Prior Publication Data

US 2023/0160264 A1 May 25, 2023

(51) Int. Cl.

| | |
|---|---|
| ***E21B 7/26*** | (2006.01) |
| ***E21B 43/267*** | (2006.01) |
| ***E21B 4/04*** | (2006.01) |
| ***E21B 10/64*** | (2006.01) |
| ***E21B 47/07*** | (2012.01) |

(52) U.S. Cl.

CPC ..... *E21B 7/26* (2013.01); *E21B 4/04* (2013.01); *E21B 10/64* (2013.01); *E21B 43/267* (2013.01); *E21B 47/07* (2020.05)

(58) Field of Classification Search

CPC ... E21B 7/26; E21B 7/267; E21B 4/04; E21B 43/267; E21B 47/07; E21B 10/64

See application file for complete search history.

(56) References Cited

U.S. PATENT DOCUMENTS

| | | | | |
|---|---|---|---|---|
| 8,269,648 | B2 | 9/2012 | Benischek et al. | |
| 9,063,252 | B2 * | 6/2015 | Kamal | G01V 11/00 |
| 9,523,789 | B2 * | 12/2016 | Kamal | G01V 11/00 |
| 10,320,311 | B2 * | 6/2019 | Gooneratne | H02N 1/04 |
| 2010/0242585 | A1 | 9/2010 | Pratyush et al. | |
| 2012/0178653 | A1 | 7/2012 | McClung, III | |
| 2021/0349230 | A1 * | 11/2021 | Al-Shehri | G01V 3/081 |

FOREIGN PATENT DOCUMENTS

WO 2010/105177 A2 9/2010

OTHER PUBLICATIONS

Alshehri, Abdallah et al., "FracBots: Overview and Energy Consumption Analysis"; Proceedings of the SPE Middle East Oil and Gas Show and Conference; Paper No. SPE-194945-MS; pp. 1-13; Mar. 18-21, 2019 (13 pages).

* cited by examiner

*Primary Examiner* — Catherine Loikith
(74) *Attorney, Agent, or Firm* — Osha Bergman Watanabe & Burton LLP

(57) ABSTRACT

A fracbot for fracturing a formation includes a drill bit; a rotary swivel configured to rotate the drill bit; a motor; a battery; and a coating encompassing the fracbot. The motor is configured to induce vibrations that create a spiral movement of the fracbot. The spiral movement of the fracbot allows the fracbot to traverse existing fractures in the formation including a first fracture and a second fracture. The battery is configured to power the fracbot. The coating is configured to dissolve at a predefined temperature. The fracbot is configured to create a channel that connects the first fracture and the second fracture.

20 Claims, 7 Drawing Sheets

METHOD AND SYSTEM FOR CONNECTING FORMATION FRACTURES USING FRACBOTS

BACKGROUND OF INVENTION

A common practice in the oil and gas industry to extend life of well is hydraulic fracturing. Hydraulic fracturing refers to the process that typically involves injecting water, sand, and chemicals under high pressure into a bedrock formation via the well. This process is intended to create new fractures in the rock as well as increase the size, extent, and connectivity of existing fractures. These existing fractures may include microfractures and natural fractures. Hydraulic fracturing is a well-stimulation technique use commonly in low permeability rocks to increase oil and/or gas flow to a well from the formation. Although the hydraulic fracturing process may aid in connectivity of existing fractures by creating hydraulic fractures, there remains a large amount of fractures unconnected.

Therefore, there is a need for a method for connecting the hydraulic fractures with the natural and micro fractures to enhance the productivity of the well and make it sustainable for a longer time.

SUMMARY OF INVENTION

In one aspect, one or more embodiments relate to a fracbot for fracturing a formation, comprising: a drill bit; a rotary swivel configured to rotate the drill bit; a motor configured to induce vibrations that create a spiral movement of the fracbot, wherein the spiral movement of the fracbot allows the fracbot to traverse existing fractures in the formation comprising a first fracture and a second fracture; a battery configured to power the fracbot; and a coating encompassing the fracbot configured to dissolve at a predefined temperature, wherein the fracbot is configured to create a channel that connects the first fracture and the second fracture.

In one aspect, one or more embodiments relate to a method of fluid extraction from a formation, comprising: pumping a liquid downhole into the formation, wherein the liquid comprises at least one fracbot coated in a coating; dissolving the coating encompassing the fracbot when a predefined temperature is reached downhole, thereby activating the fracbot; drilling, by the fracbot, a channel connecting a first fracture and a second fracture in the formation, wherein the fracbot drills by vibrational movement; and extracting the fluid out of the formation via the connected first and second fractures.

Other aspects and advantages of the invention will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
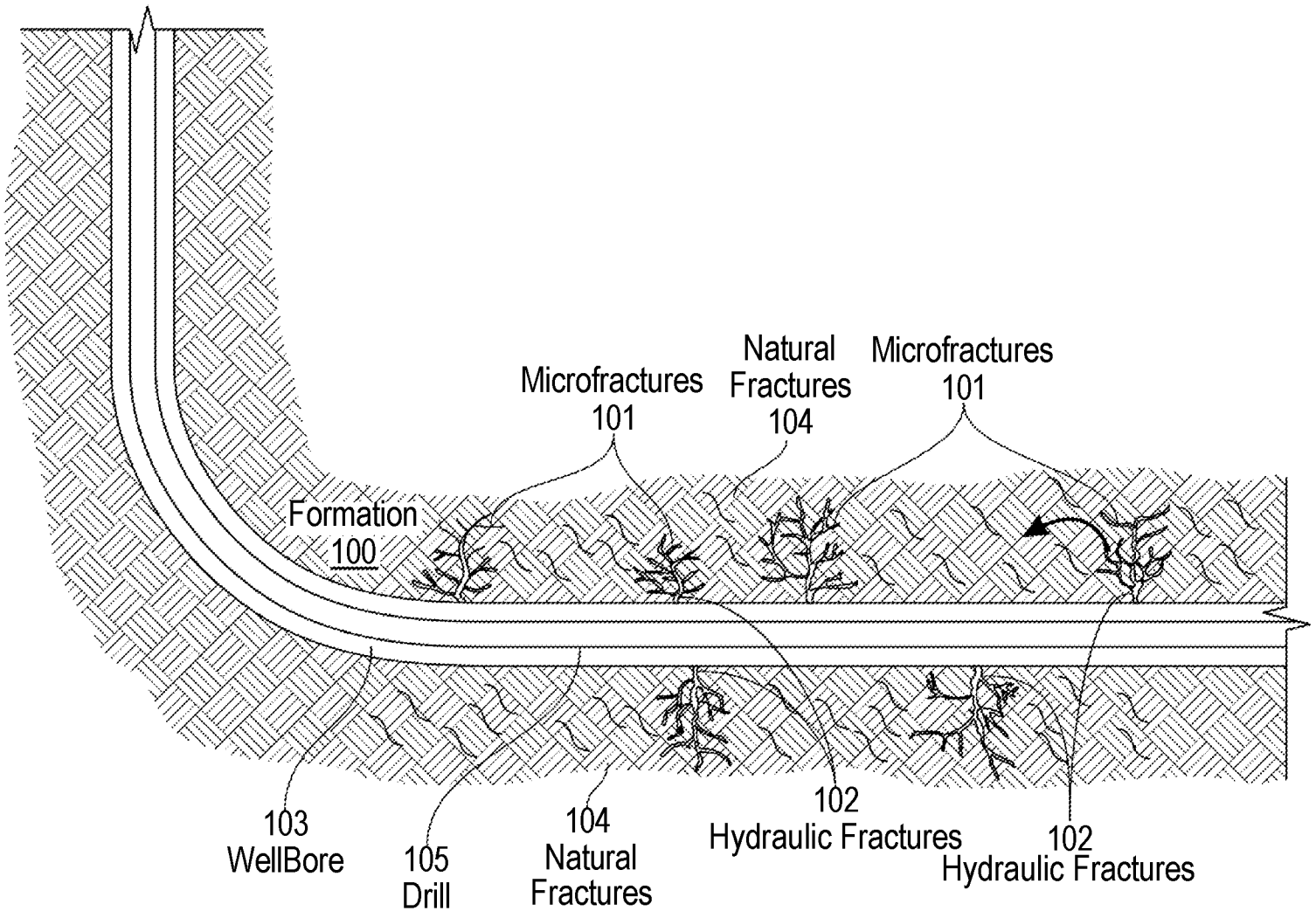
FIG. 1 depicts a well drilled formation in accordance with one or more embodiments.

FIG. 1 shows a well drilled formation (100) in accordance with one or more embodiments. The formation (100) embodies a drilled wellbore (103) and drill pipe (105). The formation (100) may be any geological formation from which drilling fluid such as oil or gas may be produced by drilling a wellbore and extracting the fluid from the formation. A wellbore may be any drilled hole used to extract hydrocarbons, gas, or water from the formation.

In one or more embodiments, the formation (100) of FIG. 1 has fractures. Fractures are separations or cracks in geological formations that divide one or more rocks. Fractures may be microfractures (101), natural fractures (104), or hydraulic fractures (102). Microfractures (101) may be openings created after hydraulic fracturing that are smaller than the hydraulic fractures (102). Hydraulic fractures (102) are fractures created after hydraulic fracturing of a well formation (100). Hydraulic fracturing operations result in micro fractures that are created around the hydraulic fractures in addition to the natural fractures that already exist in the formation (100). In one or more embodiments, channels are created by micro robots (i.e. Fracbots) to connect these separate types of fractures in a formation to boost the productivity of the formation and make it sustainable for longer time. While FIG. 1 depicts hydraulic fractures (102) as branches, those skilled in the art will appreciate that hydraulic fractures may have different geometries including but not limited to triangles, for example.

Figure 2:
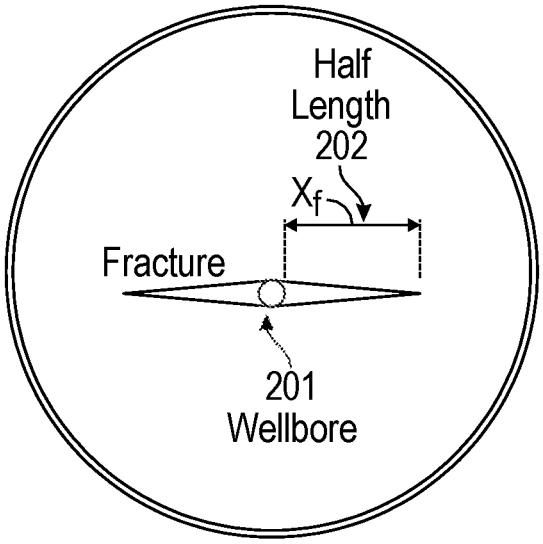
FIG. 2 shows a hydraulic fracture from a wellbore in accordance with one or more embodiments.
Figure 3:
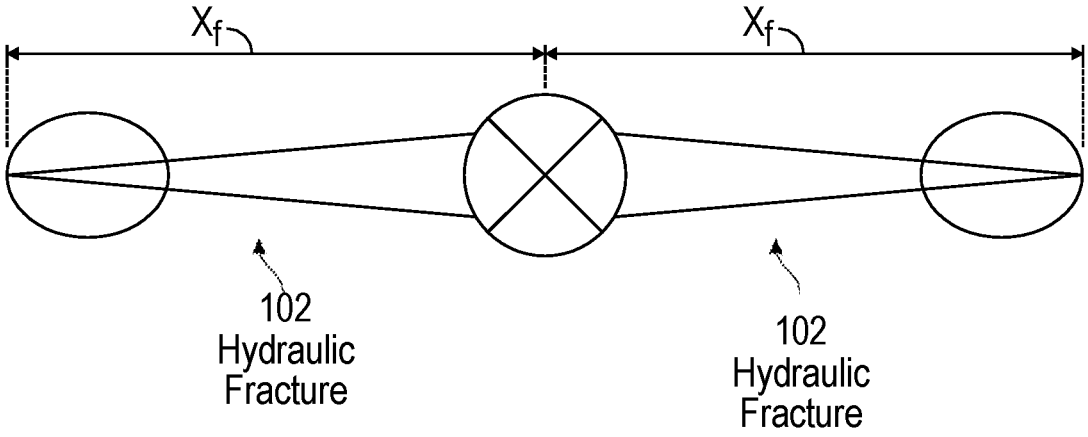
FIG. 3 shows a hydraulic fracture from a wellbore in accordance with one or more embodiments.

FIGS. 2 and 3 show a hydraulic fracture from a wellbore (201) in accordance with one or more embodiments. Specifically, the hydraulic fracture (102) has a half-length (202). The half-length (202) of a fracture is the radial distance from the wellbore (201) to the outer tip of the fracture. A hydraulic fracture (102) may be any cracks in rock formations created by injection of pressurized liquid in the formation. The natural formation permeability dictates whether the hydraulic fracture will be connected to the micro fractures and natural fractures or not, which will affect the productivity of the well. The hydraulic fractures (102) may be held open by proppants such as sand once the hydraulic pressure is removed from the well. Although after placing the hydraulic fracture there is no way to ascertain the fracture geometry, FIGS. 2 and 3 are examples of the geometrical shape a hydraulic fracture (102) can take on.

In one or more embodiments, proppant sized FracBots (discussed below in FIGS. 4-9) are pumped at the tip of the fracture half length (XI) (202) as shown in FIGS. 2 and 3. The FracBots may be placed at any pumping stage during fracturing operations or injection operations. In one or more embodiments, the FracBots may be retrieved after flow back when the FracBots are placed at the beginning of the fracture half length (Xf) (202). Flow back is the process of recovering fluid to the surface after being injected. In one or more embodiments, the FracBots may be placed at the beginning of the fracture half length (Xf) (202) by disposing them at a last pumping stage. The pumping stages may be estimated through simulation programs which depict different sizes of proppant and other factors. Other factors may include, but are not limited to, a type of formation (100), porosity, and permeability.

In one or more embodiments, a FracBot is an automated mechanical device, or a robot, configured to activate upon entering any type of fracture in a formation in order to create one or more channels connecting existing fractures. As disclosed herein, there are two types of FracBots: a Frac Microbot and a Fracworm, each with different physical properties. FIGS. 4-6 and 7-9 discuss the Frac Microbot and the Fracworm, respectively.

Figure 6:
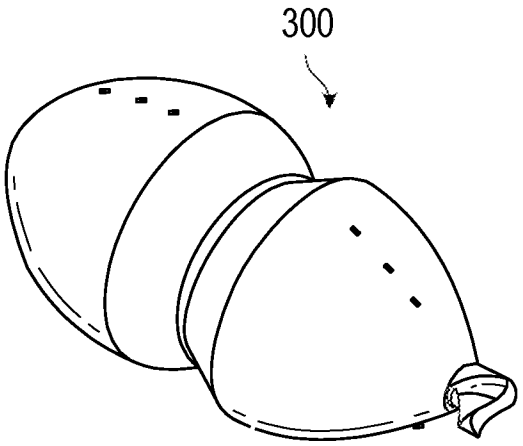
FIG. 6 shows a dimensional drawing of a specific type of Fracbot in accordance with one or more embodiments.
Figure 5:
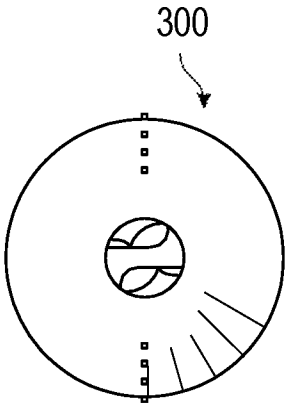
FIG. 5 shows a dimensional drawing of a specific type of Fracbot in accordance with one or more embodiments.
Figure 4:
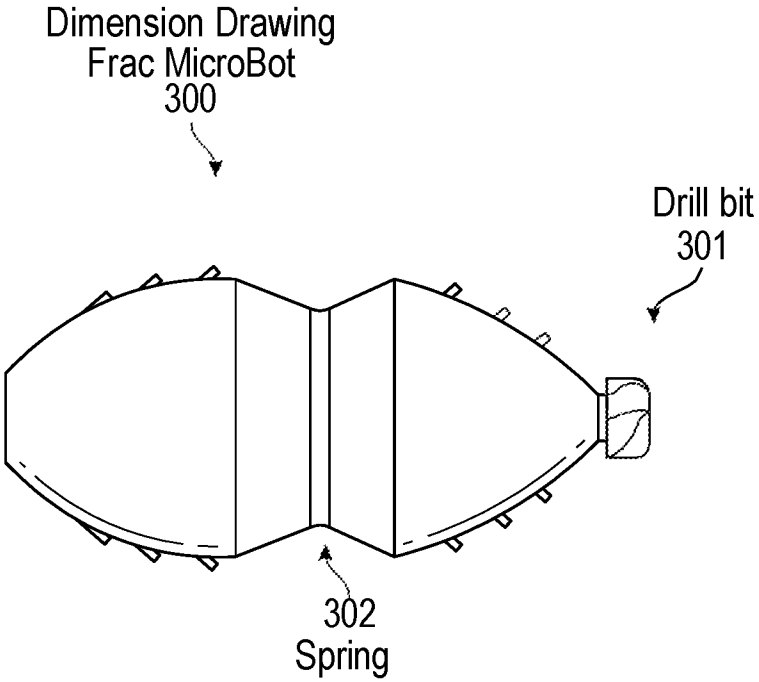
FIG. 4 shows a dimensional drawing of a specific type of Fracbot in accordance with one or more embodiments.

FIGS. 4-6 each show a dimensional drawing of a Frac Microbot (300). In one or more embodiments, the Frac Microbot (300) is a specific type of FracBot. The Frac Microbot (300) may have a smooth conical shape as shown, with no arms to help aid in movement of the Frac Microbot (300). In the example of FIGS. 4-6, the Frac Microbot (300) may have a conical shape with an indention in the middle where a spring (302) is disposed to help aid in movement of the Frac Mircobot (300). The spring (302) may be of any material and/or shape with the ability to store energy and release it. The spring creates a springing or jumping action to help move the Frac Microbot (300) within a fracture. In one or more embodiments, the Frac Microbot (300) has a drill bit (301) at the cone-shaped end of the Frac Microbot (300). The drill bit (301) rotates to drill the channels between existing fractures in the formation to connect the existing fractures. The drill bit (301) may be any tool of any size with a cutting ability to create holes or cut through formation. For example, the drill bit (301) may have the ability to rotate in a circular cross-section motion to create holes by removing material in the formation (100) in different materials downhole. The drill bit (301) may be of any type of material that can cut depending on the formation characteristics. Those skilled in the art will appreciate that the drill bit (301) of the Frac Microbot (300) may be smaller in size than a drill string drill bit to accommodate for the overall size of the Frac Microbot (300).

The Fracbots (300, 303) are proppant sized and are pumped downhole along with the proppant. Specifically, for example, the Frac Microbot (300) may have the dimensions in the range of 1.5 mm to 4 mm in length and 0.5 mm to 2 mm in width. Movement of the Frac Microbot may be facilitated in multiple ways. For example, movement of the Frac Microbot may be facilitated by vibrations from rotation of the drill bit (301) that may create a spiral movement, allowing the Frac Microbot (300) to move within or around a fracture. The vibrations may originate from the FracBot itself. The spring (302) may add to vibration movement through the springing or jumping action.

Figure 9:
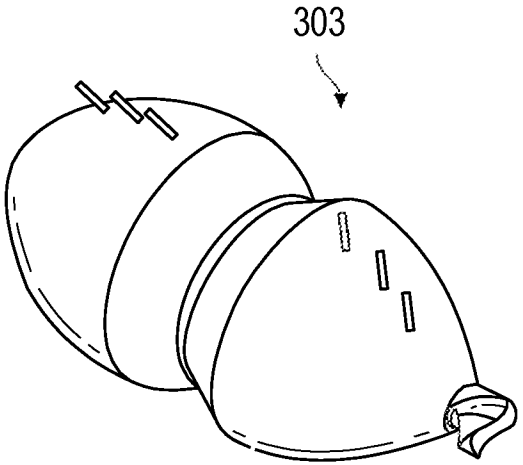
FIG. 9 shows a dimensional drawing of a specific type of Fracbot in accordance with one or more embodiments.
Figure 8:
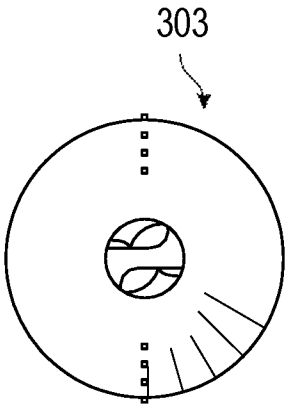
FIG. 8 shows a dimensional drawing of a specific type of Fracbot in accordance with one or more embodiments.
Figure 7:
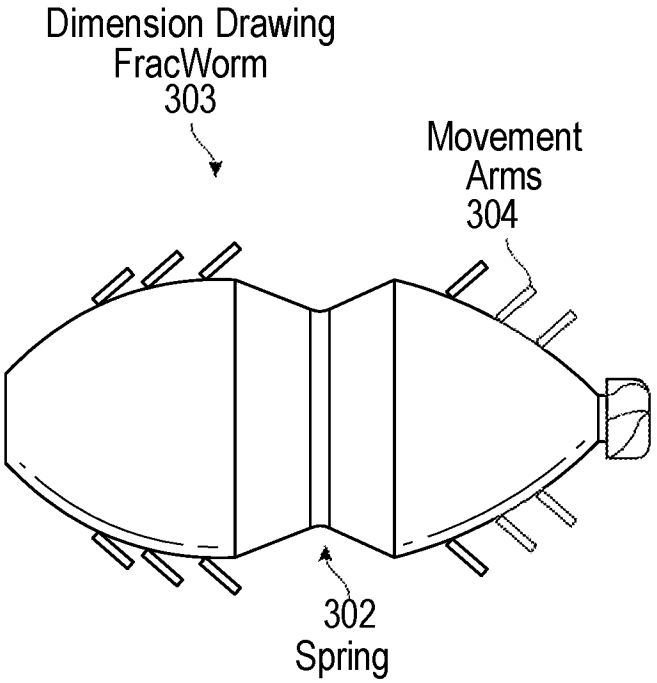
FIG. 7 shows a dimensional drawing of a specific type of Fracbot in accordance with one or more embodiments.

FIGS. 7-9 show a dimensional drawings of a Fracworm (303), which is a specific type of FracBot. Specifically, the Fracworm embodies all of FIGS. 4-6 of the Frac Microbot with an addition of movement arms (304) attached to the outside of the body. The movement arms (304) may be used to aid in movement of the Fracworm (303) within a formation fracture. Additionally, in one or more embodiments, the movement arms (304) facilitate anchoring of the Fracworm (303) to help with creating channels once the Fracworm is disposed within a fracture or at the end of a fracture. The movement arms may move by rotation, upward and downward "flapping" movement, in an "S" movement, or any other suitable movement to aid in overall Fracworm (303) movement. Alternatively, in one or more embodiments, the movement arms may not move themselves, but instead may be used to push the Fracworm (303) through the fractures in the formation. The movement arms (304) may be of any material that helps the Fracworm (303) anchor itself and move with the vibrations of the drill bit (301). The distribution of the movement arms (304) may be of any distance or number based on the type of formation or the design of the Fracworm.

Each of the Fracbots (300, 303) may include additional components in addition to the drill bit and spring, as shown in FIGS. 5A and 5B and discussed below.

Figure 10:
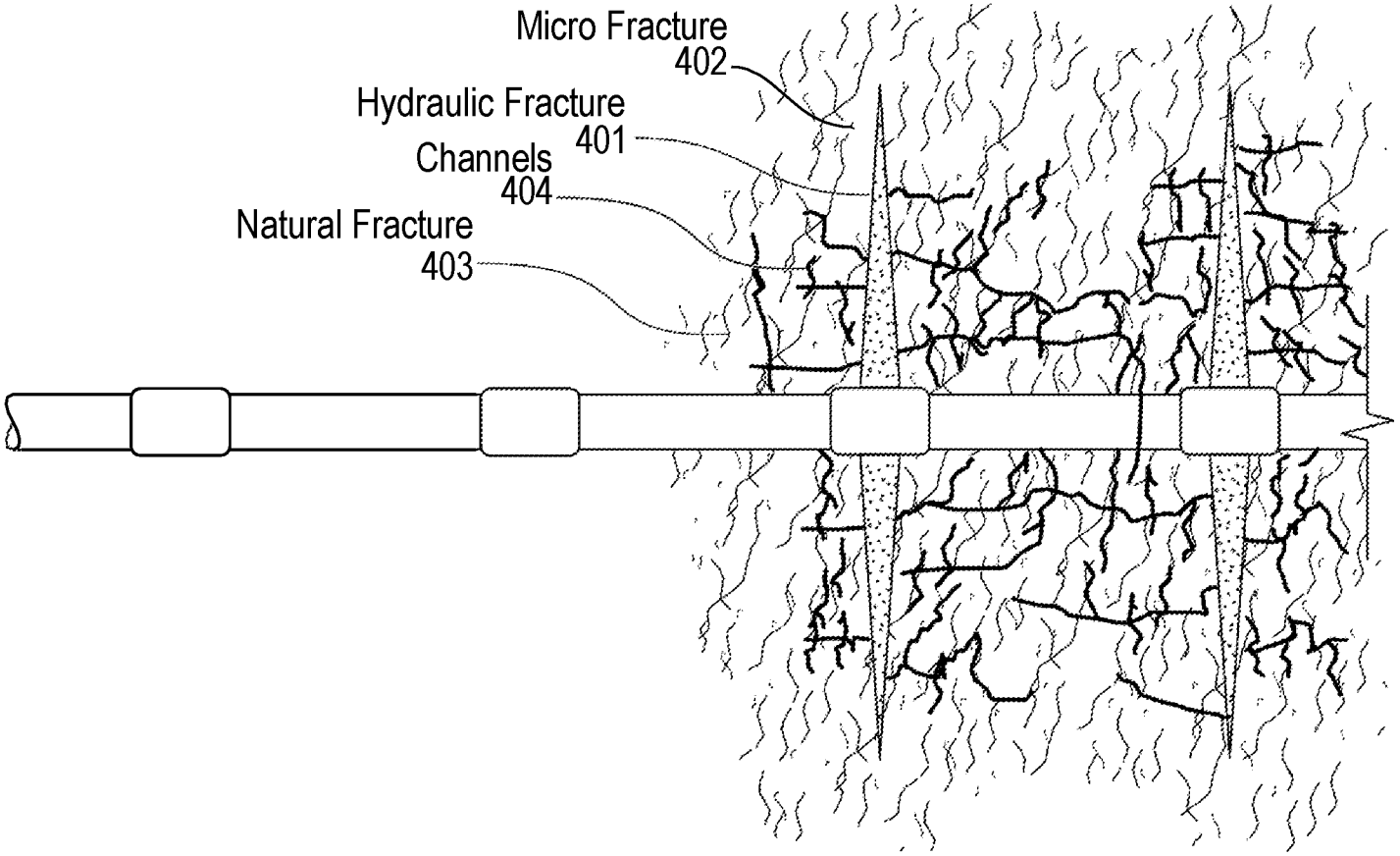
FIG. 10 depicts an example formation with fractures made by Fracbots in accordance with one or more embodiments.

FIG. 10 depicts a formation (100) after hydraulic fracturing and usage of Fracbots (300, 303) in accordance with one or more embodiments. FIG. 10 includes the fractures shown in in FIG. 1 and depicts the channels (404) created by the Fracbots (300, 303) to connect the existing fractures. As discussed above, the Fracbot may be an automated robot used to create channels (404) between fractures. The channels (404) may connect pores in the formation to the wellbore as well as make connections between fractures. Considering the existence of a large number of random natural fractures (104) in some formations (100), there is not an effective way to model the shape and location of the fractures. For example, the hydraulic fractures (102) are branched from the wellbore (103) with natural fractures (104) and microfractures (101) distributed around the hydraulic fractures (102). The channels (404) created by the Fracbots (300, 303) may start from the hydraulic fracture (102) and extend to one or more microfractures (101). Alternatively, the channels (404) may start from the natural fractures (104) and extend to one or more microfractures (101). Although FIG. 4 depicts channels (404) connecting hydraulic fractures (401) to micro fractures (402) and natural fractures (403) as pathways, the channels (404) could move in a more sparse and random way without departing from the scope herein.

Figure 11:
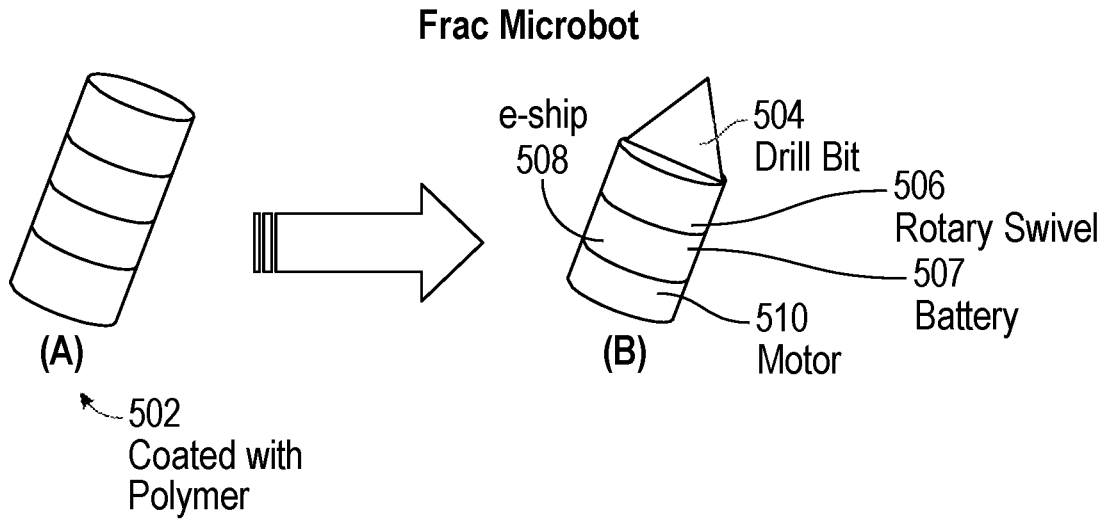
FIG. 11 shows a specific type of Fracbot in accordance with one or more embodiments.
Figure 12:
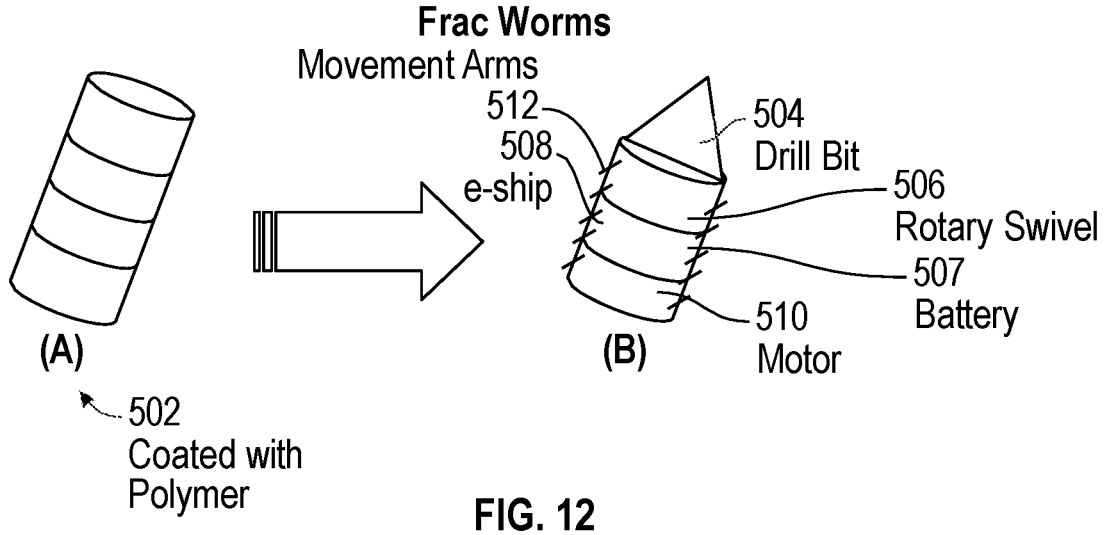
FIG. 12 shows a specific type of Fracbot in accordance with one or more embodiments.

FIGS. 11 and 12 show Fracbot flow diagrams and addition components of the Fracbots. More specifically, FIGS. 11 and 12 depict a flow from (A) to (B). (A) depicts a figure showing the Fracbot coated with a polymer. In one or more embodiments, each Fracbot is coated in polymer (502) or any other suitable coating material before it is disposed in the proppant and sent downhole to the formation fractures. The polymer coating dissolves at different temperatures dependent on the particular makeup of the polymer coatings. There may be different types of polymer coating recipes that dissolve at different temperatures and there are many already available in the industry. In this example, the polymer coating chosen is based on the necessity to dissolve under the specific reservoir temperature conditions. The polymer coating is used to protect the surface of the Fracbot and downhole equipment. The outer polymer coating dissolves due to temperature and reveals the components of the Fracbot shown in (B). The movement arms (304) may be of any length and diameter of 0.001% in comparison to the size of the Fracworm (303). Specifically, the polymer coating dissolves upon reaching a range of high temperatures downhole. In (B) of FIG. 11, the FracBot includes a drill bit (504), a rotary swivel (506) operatively connected to the drill bit (504), a battery (507) and e-ship (508) to power the motor (510) of the Fracbot, and a motor (510) that runs the drill bit (504). The FracBot is configured to send real-time pressure and temperature readings via a sensor on the FracBot. FIG. 12 includes all embodiments of FIG. 11 with addition of the movement arms (512).

The rotary swivel (506) is a precision component for the connection between stationary equipment and rotating parts. The battery (507) and e-ship (508) may be separate or together. In one or more embodiments, the e-ship (508) is an electronic chip that aids in the activation of the FracBots via, for example, a preprogramed timer or pre-set temperature. Typically, the initial temperature in the formation (100) is lower than the temperature after hydraulic fracturing operations are completed. Thee rise in temperature may be one activation method of dissolving the polymer (502) coating. The e-ship (508) includes the sensor needed to retrieve and send data. The sensor readings may be retrieved in real time or recovered by retrieving the FracBots. One way to retrieve the FracBot is through flow back.

The battery (507) supplies power to the motor to set the FracBot in motion. The battery (507) may activate at the point of dissolvement of the polymer (502) coating. FracBots continue to move until the battery (507) life runs out.

Figure 13:
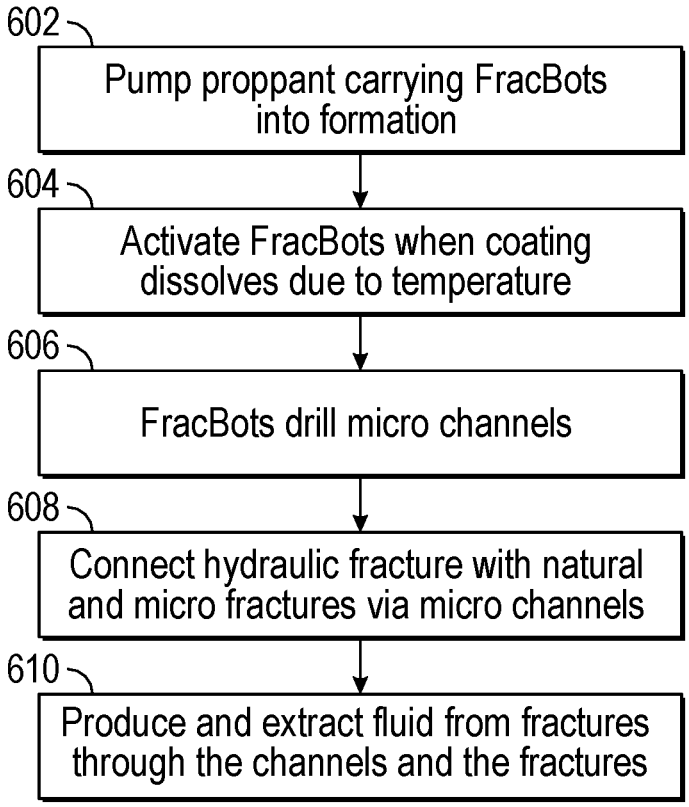
FIG. 13 shows a flow chart in accordance with one or more embodiments.

FIG. 13 shows a flowchart in accordance with one or more embodiments. Specifically, the flowchart illustrates a method for increasing flow in production from a formation using Fracbots (300, 303). Further, one or more blocks in FIG. 13 may be performed by one or more components as described in FIGS. 1-12. While the various blocks in FIG. 13 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, one or more Fracbots (300, 303) are pumped into the well formation (100) through a liquid (Block 602). In this disclosure, the number of FracBots needed for a significant effect is hundreds. The amount of FracBots to be pumped depends on many factors which include, but are not limited to, rock permeability and formation type. The FracBots may be Frac MicroBots (300), Fracworms (303), or both. The liquid may be made a proppant or any type of liquid that can be pumped downhole and is capable of carrying the Fracbots (300, 303) to an existing fracture half-life. The Fracbots may be pumped through tubing or casing. In Block 604, the Fracbots are activated in the formation (100) when the polymer (502) coating of the robot dissolves when reaching a predetermined temperature. Once the Fracbots activate, their movement may be initiated by vibration of the drill bit or the motor (510) of the Fracbot. In Block 606, Fracbots drill through the formation between existing fractures to create micro channels (404). In this case of a Fracworm, the Fracworm may anchor itself at a particular location at the end of or within an existing fracture using the movement arms of the Fracworm and then begin drilling the formation to create channels. The micro channels are used to connect existing fractures in the formation (100) thereby creating a path for fluid flow that did not exist among disjoint and disconnected hydraulic and/or natural fractures in the formation (Block 608). Channels may be micro in size. Channels may be drilled from the body of the Fracbot or the drill bit (301) of the Fracbot. In the case of Fracworms, channels may also be drilled by the movement arms (304) of the Fracworm (303).

In Block 610, fluid is produced via a well from the fractures using the micro channels created by the Fracbots. Production from fractures and pores is well known in the industry as it is a common method of fluid extraction. Embodiments disclosed herein provide the ability to create channels to connect the hydraulic fractures with the micro fractures around it in addition to the natural fractures which boosts the productivity of the reservoir/formation and make it sustainable for longer time. It will also reduce the number of stages required to reach the required gas or oil rate. In addition, although not shown in FIG. 13, the Fracbots send live pressure and temperature which can be used to enhance the fracturing design.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of fluid extraction from a formation, comprising:

pumping a liquid downhole into the formation, wherein the liquid comprises at least one fracbot coated in a coating;

dissolving the coating encompassing the fracbot when a predefined temperature is reached downhole, thereby activating the fracbot;

drilling, by the fracbot, a channel connecting a first fracture and a second fracture in the formation, wherein the fracbot drills by vibrational movement; and extracting the fluid out of the formation via the connected first and second fractures.

2. The method of claim 1, further comprising: transmitting, via one or more sensors on the fracbot, temperature and pressure measurements to the Earth's surface.

3. The method of claim 1, further comprising: anchoring the fracbot in the formation near the first fracture or the second fracture using a plurality of arms disposed on the fracbot.

4. The method of claim 1, wherein the first fracture is a hydraulic fracture and the second fracture is a natural fracture.

5. The method of claim 1, wherein the first fracture is a natural fracture and the second fracture is a micro fracture.

6. The method of claim 1, wherein the coating is a polymer coating that protects the fracbot until the predefined temperature is reached.

7. The method of claim 1, wherein the liquid comprises a proppant.

8. The method of claim 7, wherein the liquid carries a plurality of fracbots to a plurality of fractures in the formation, wherein a number of fracbots depends on the type of formation.

9. The method of claim 1, further comprising: disposing the fracbot at a fracture half length of the first or second fracture by disposing the fracbot at a last pumping stage.

10. The method of claim 9, further comprising: retrieving the fracbot via a flowback of the fluid from the formation.

11. A fracbot for fracturing a formation, comprising:

a drill bit;

a rotary swivel configured to rotate the drill bit;

a motor configured to induce vibrations that create a spiral movement of the fracbot, wherein the spiral movement of the fracbot allows the fracbot to traverse existing fractures in the formation comprising a first fracture and a second fracture;

a battery configured to power the fracbot; and a coating encompassing the fracbot configured to dissolve at a predefined temperature, wherein the fracbot is configured to create a channel that connects the first fracture and the second fracture.

12. The fracbot of claim 11, further comprising: a plurality of arms configured to facilitate in movement of the fracbot.

13. The fracbot of claim 12, wherein the plurality of arms are further configured to anchor the fracbot near the existing fractures in the formation.

14. The fracbot of claim 11, further comprising: a spring disposed at a mid-section of the fracbot, wherein the spring is configured to move the fracbot with a spring action.

15. The fracbot of claim 11, wherein the fracbot is between 2 mm and 4 mm in length and between 1 mm and 2 mm in width.

16. The fracbot of claim 11, wherein the first fracture is a hydraulic fracture and the second fracture is a natural fracture.

17. The fracbot of claim 11, wherein the first fracture is a natural fracture and the second fracture is a micro fracture.

18. The fracbot of claim 11, wherein the coating is a polymer coating that protects the fracbot until the predefined temperature is reached.

19. The fracbot of claim 11, wherein the channel created by the fracbot allows fluid to be extracted via the first fracture and the second fracture.

20. The fracbot of claim 11, further comprising: an electronic chip configured to activate the fracbot based on a timer or a predefined temperature setting, wherein the electronic chip houses a sensor configured to send pressure and temperature measurements to the Earth's surface.

* * * * *